US010150308B2

(12) United States Patent
Nohara et al.

(10) Patent No.: US 10,150,308 B2
(45) Date of Patent: Dec. 11, 2018

(54) PORTABLE PRINTER, ATTACHING ADAPTER, AND PRINTER

(71) Applicant: Brother Kogyo Kabushiki Kaisha, Nagoya-shi, Aichi-ken (JP)

(72) Inventors: Shuhei Nohara, Kasugai (JP); Takamine Hokazono, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/268,084

(22) Filed: Sep. 16, 2016

(65) Prior Publication Data

US 2017/0080723 A1 Mar. 23, 2017

(30) Foreign Application Priority Data

Sep. 18, 2015 (JP) ..... 2015-185809

(51) Int. Cl.
*B41J 2/32* (2006.01)
*B41J 11/04* (2006.01)
*B41J 3/36* (2006.01)

(52) U.S. Cl.
CPC ..... *B41J 11/04* (2013.01); *B41J 2/32* (2013.01); *B41J 3/36* (2013.01)

(58) Field of Classification Search
CPC ... B41J 25/34; B41J 2/304; B41J 2/335; B41J 11/02; B41J 11/04; B41J 11/057; B41J 11/06; B41J 11/08; B41J 11/10; B41J 11/13; B41J 25/304; B41J 25/312; B41J 25/316; B41J 25/308; B41J 25/3082; B41J 25/3088; B41J 25/3084; B41J 25/3086
See application file for complete search history.

(56) References Cited

U.S. PATENT DOCUMENTS 5,570,962 A 11/1996 Suzuki et al.
9,013,528 B2 * 4/2015 Takahashi ..... B41J 11/04 347/171

FOREIGN PATENT DOCUMENTS

JP H06-037714 5/1994
JP H07-309041 A 11/1995
JP 2002-019228 A 1/2002

OTHER PUBLICATIONS

Jul. 24, 2018—(JP) Notification of Reasons for Refusal—App 2015-185809.

* cited by examiner

*Primary Examiner* — Kristal Feggins
(74) *Attorney, Agent, or Firm* — Banner & Witcoff, Ltd.

(57) ABSTRACT

The disclosure discloses a portable printer including a printer main body and an attaching adapter. The printer main body includes a platen roller, a thermal line head, and a housing. The platen roller is configured to feed a sheet to be printed. The thermal line head is configured to form print on the sheet to be printed fed by the platen roller. The housing encompasses the platen roller and the thermal line head and includes an attachment/detachment recess configured to attach or detach a battery unit for driving the platen roller and the thermal line head. The attaching adapter has an outer shape substantially the same as an outer shape of the battery unit, is configured to be attached to the attachment/detachment recess of the printer main body, and includes an attachment portion for attaching the printer main body to an attachment target.

8 Claims, 12 Drawing Sheets

[FIG. 1]
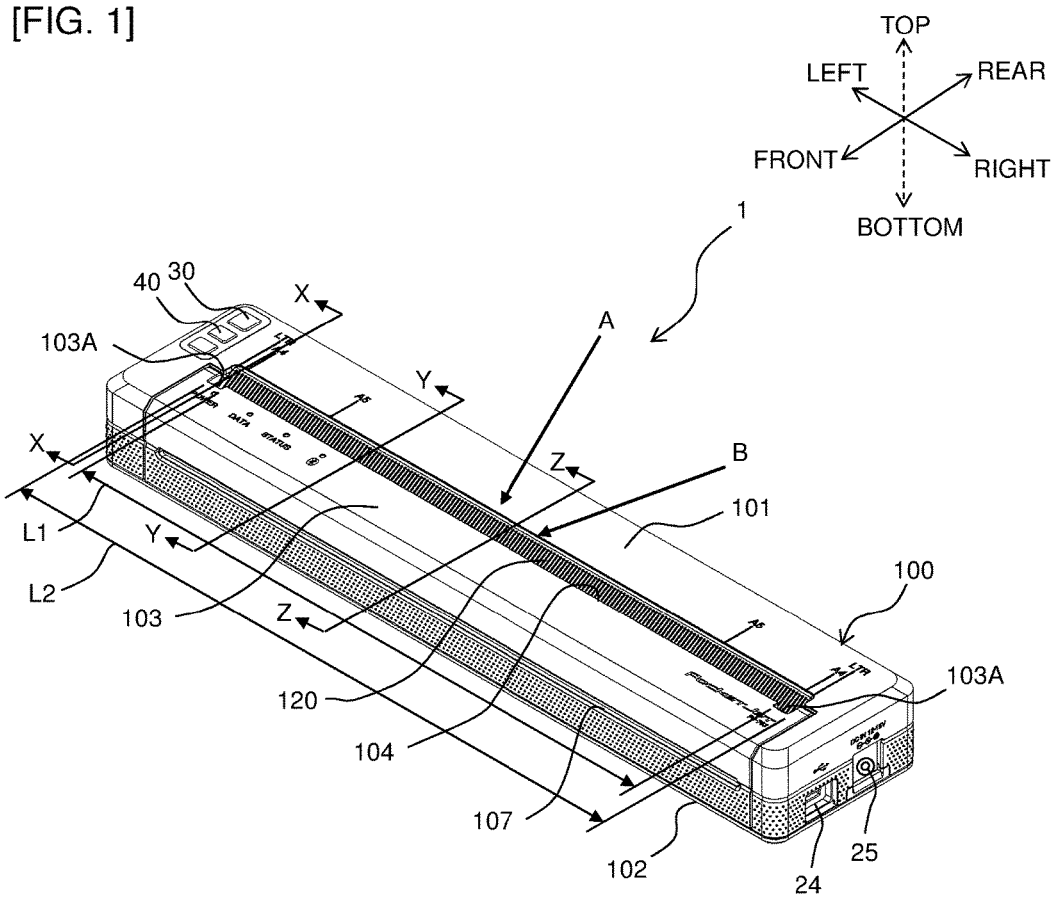

[FIG. 2]
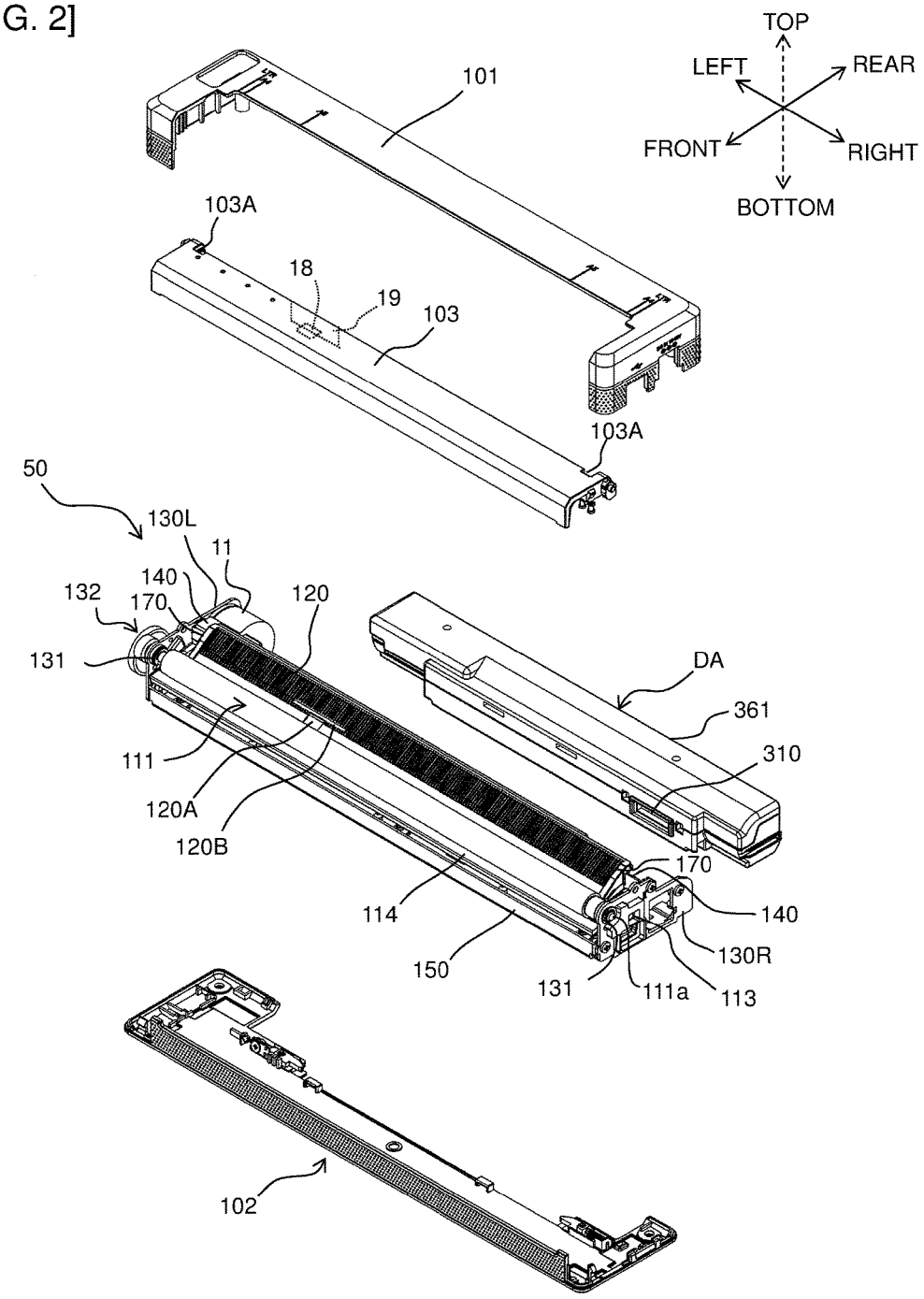

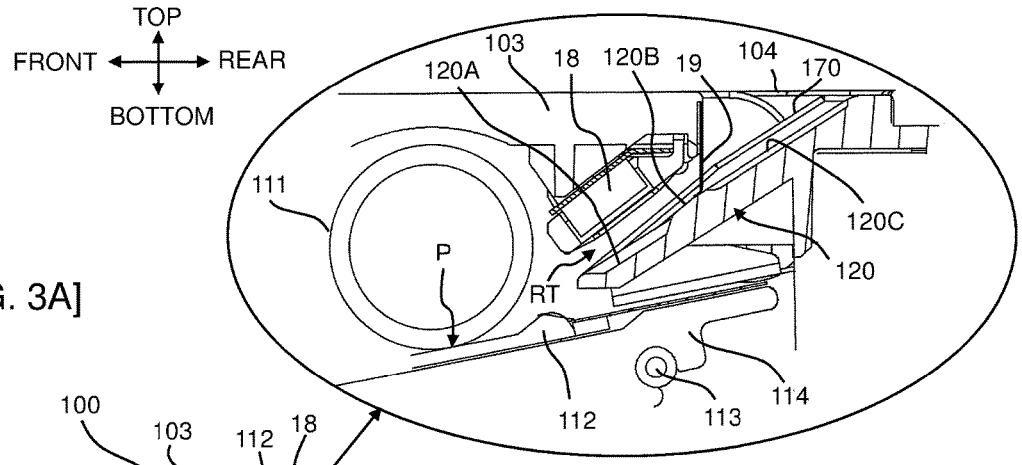
[FIG. 3A]
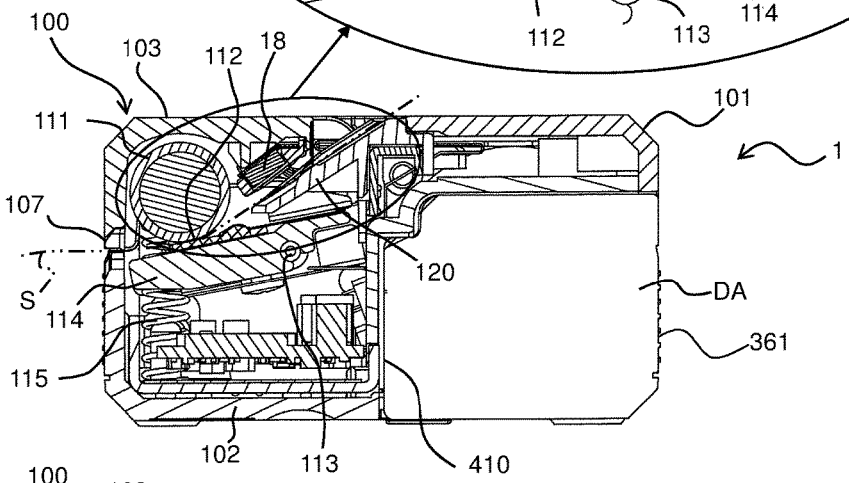
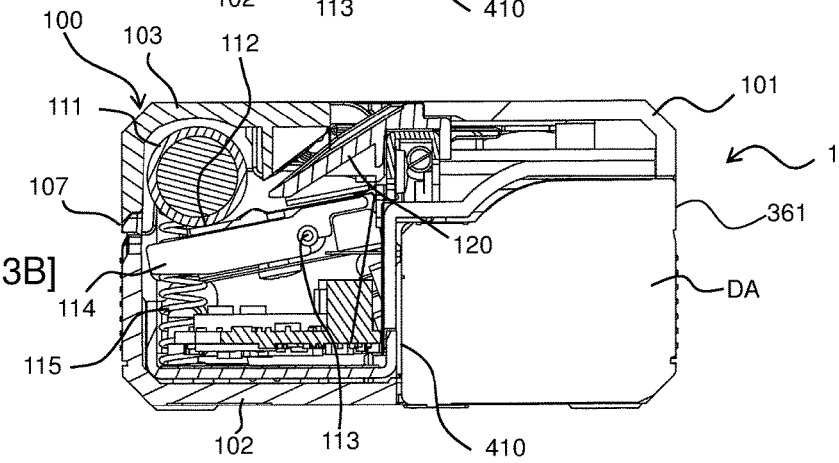
[FIG. 3B]

[FIG. 4]
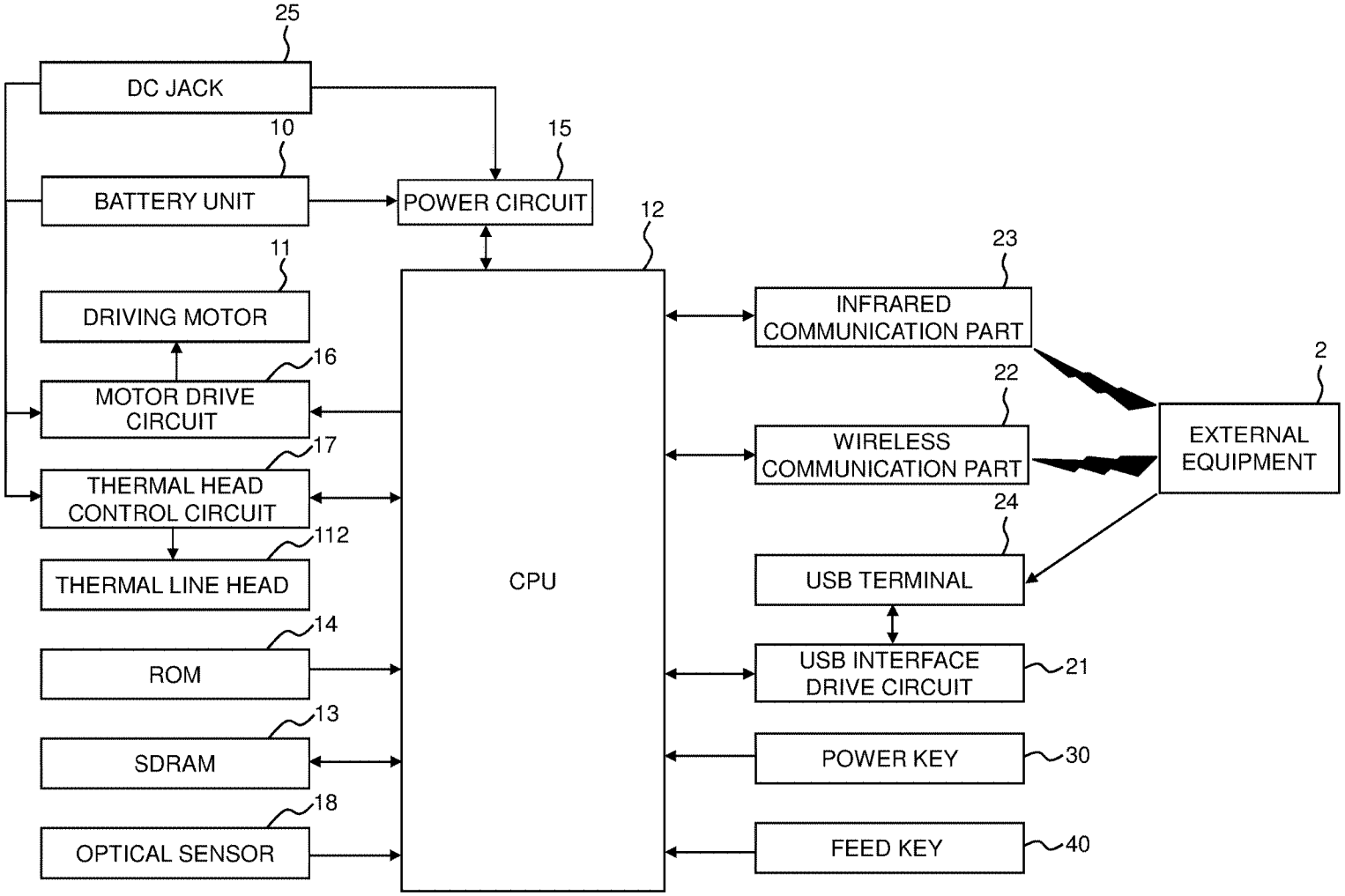

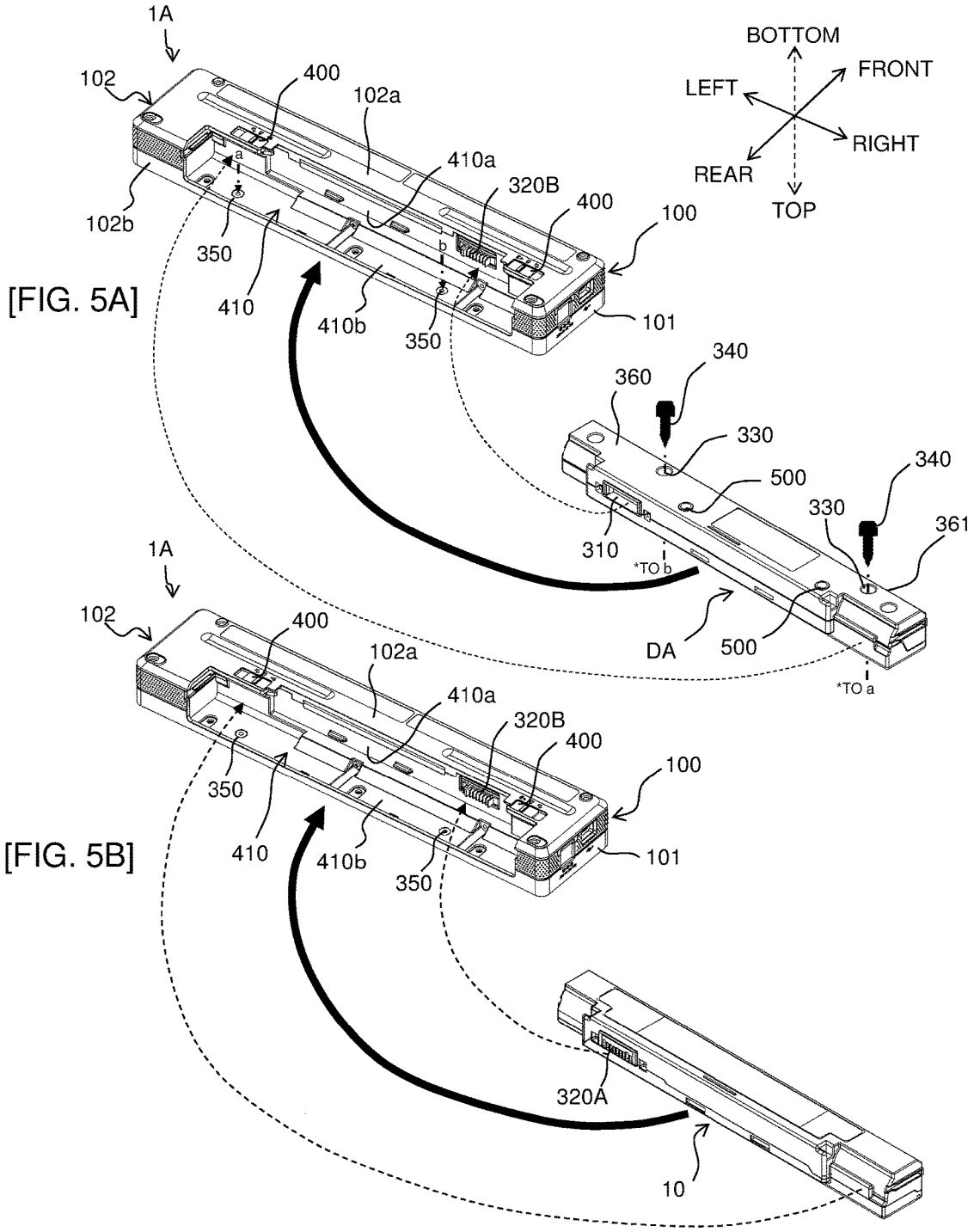
[FIG. 5A]
[FIG. 5B]

[FIG. 6]
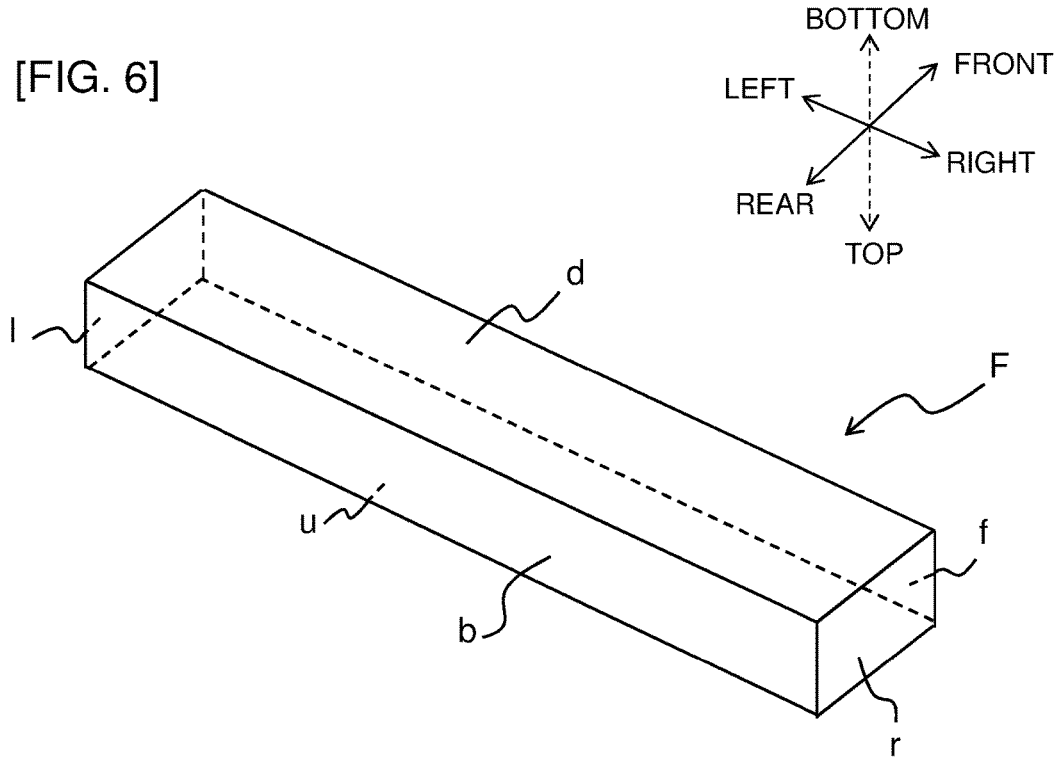

[FIG. 7]
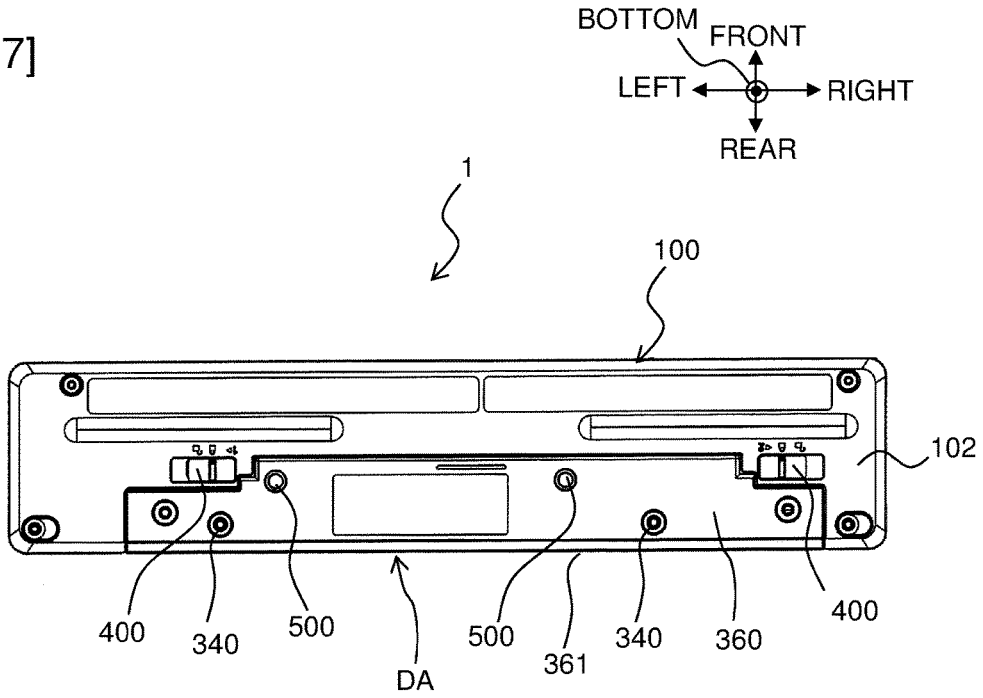

[FIG. 8A]
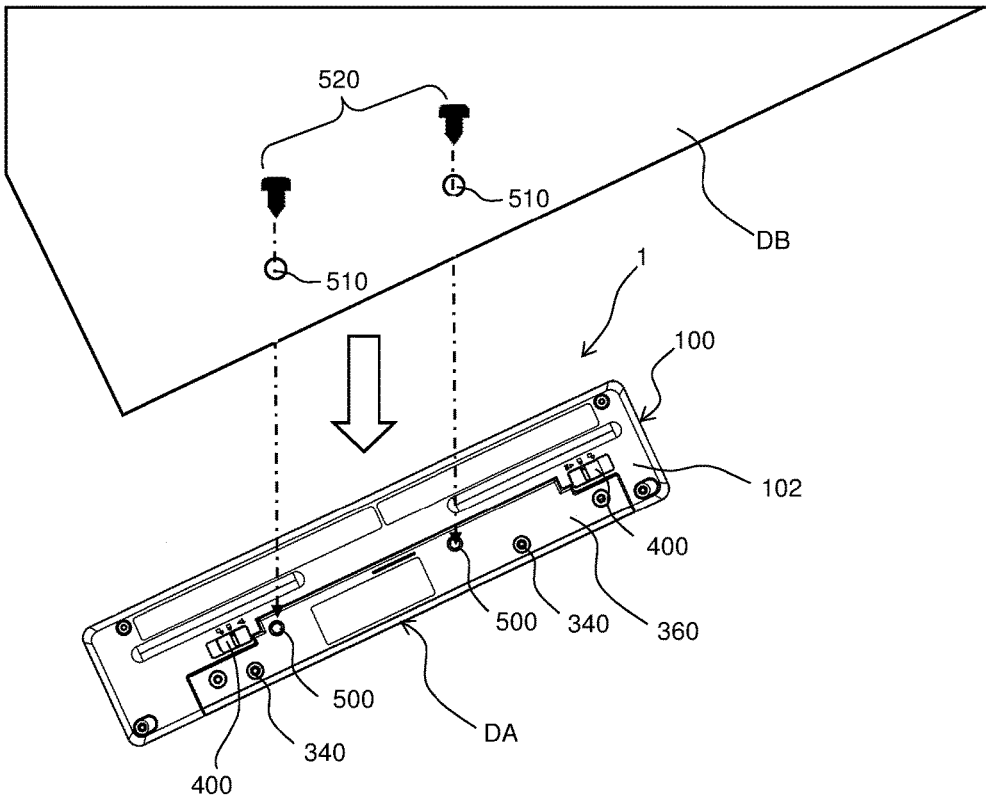
[FIG. 8B]
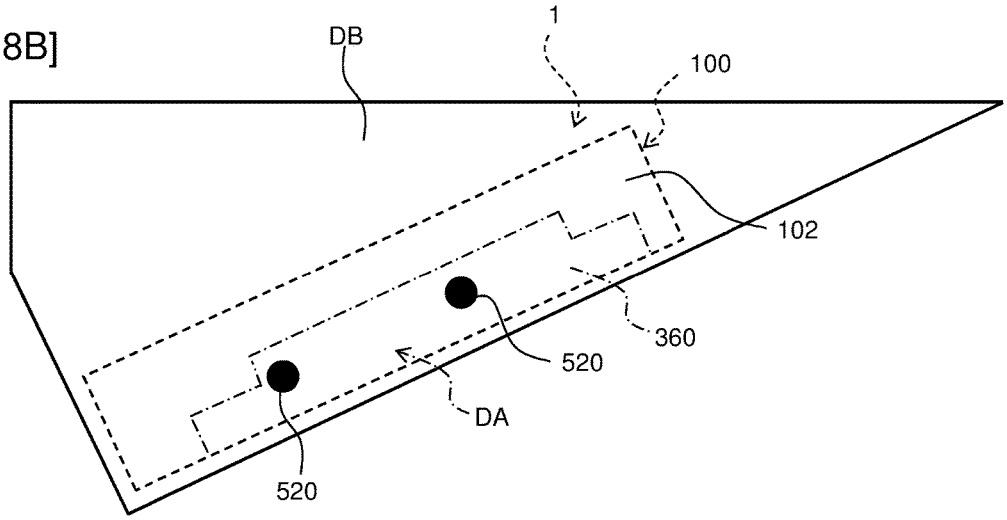

[FIG. 9]
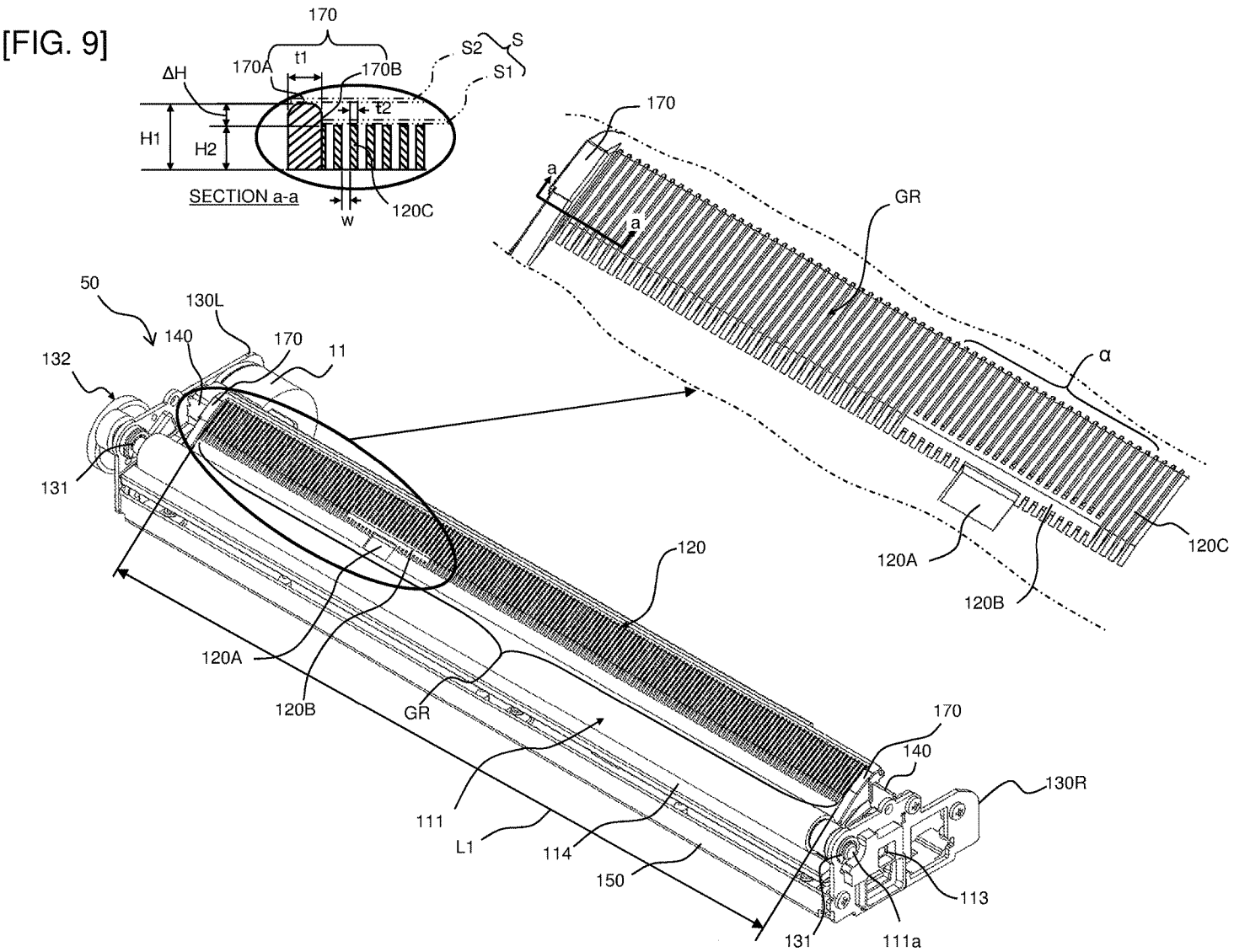

[FIG. 10A]
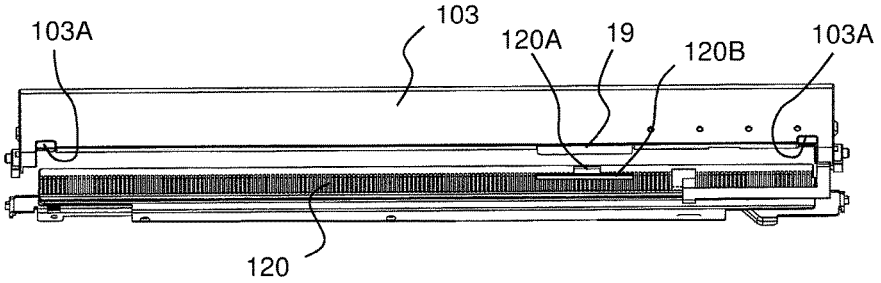
[FIG. 10B]
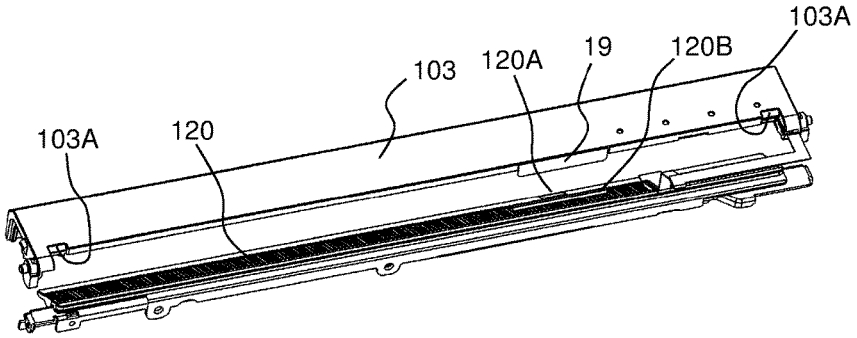
[FIG. 10C]
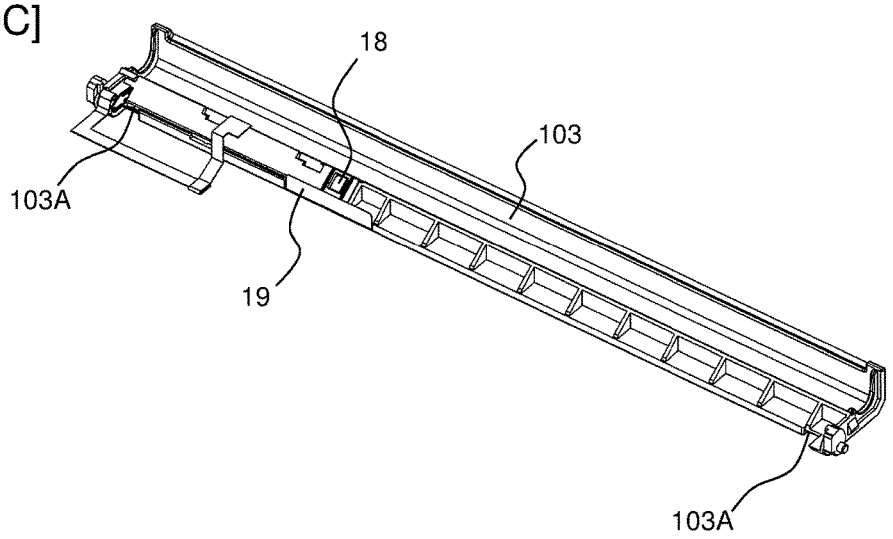

[FIG. 11]
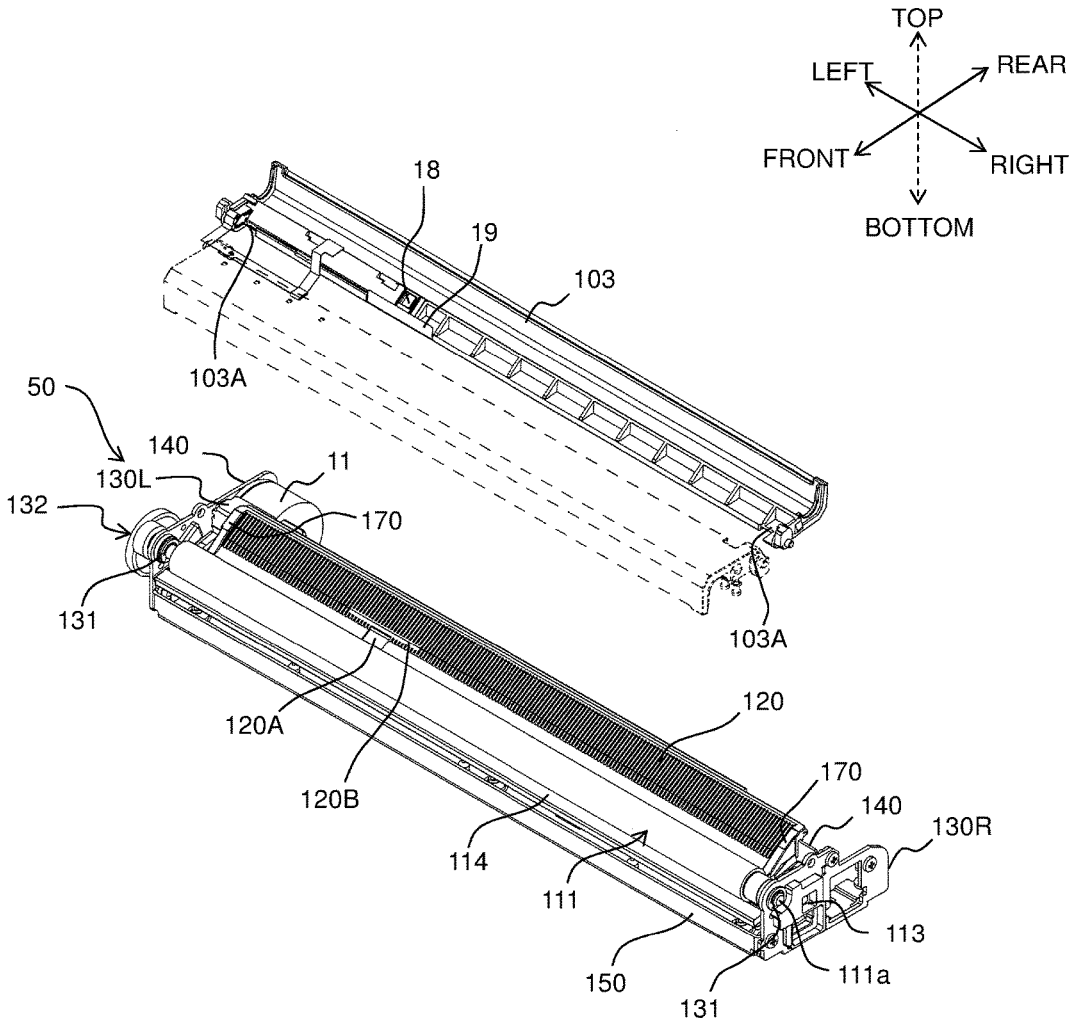

[FIG. 12A]
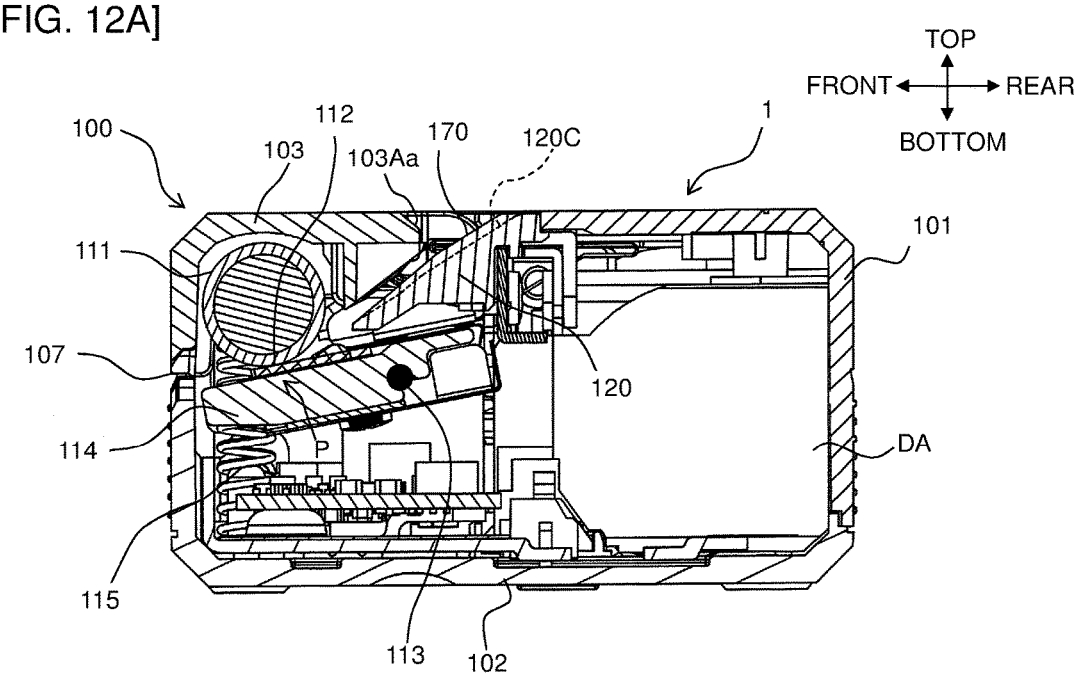
[FIG. 12B]
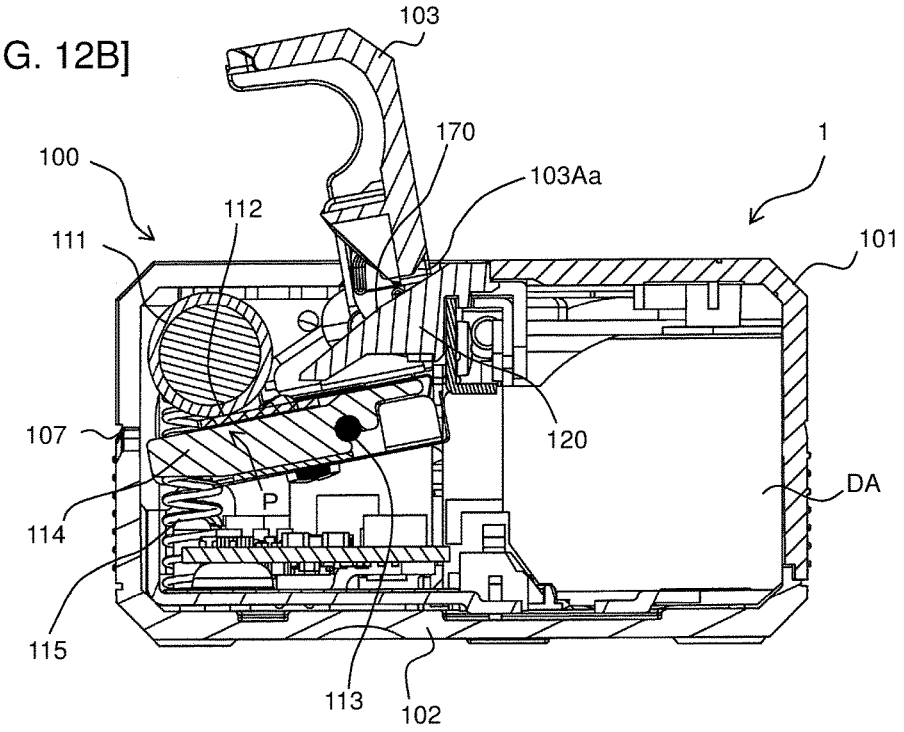

PORTABLE PRINTER, ATTACHING ADAPTER, AND PRINTER

CROSS-REFERENCE TO RELATED APPLICATION

The present application claims priority from Japanese Patent Application No. 2015-185809, which was filed on Sep. 18, 2015, the disclosure of which is incorporated herein by reference in its entirety.

BACKGROUND

Field

The present disclosure relates to a portable printer performing desired printing on a sheet to be printed, an attaching adapter for use therewith, and a printer.

Description of the Related Art

A portable printer capable of battery drive is already known. In this printer, a platen roller and a thermal line head are driven by power supplied from a battery (nickel-cadmium battery) stored in a battery storage space (battery chamber) of a housing, with the result that desired printing can be performed on a sheet to be printed (heat-sensitive paper).

Recently, in such a portable printer, a configuration is being advocated which enables the drive by power from an external power device through the connection of an AC adapter, in place of power supply from the battery as described above.

On the other hand, new need is occurring to carry the printer and attach it to a desired location (hereinafter, referred to appropriately as "attachment target") e.g. on a vehicle such as an automobile or a work vehicle or on a building, for use. In the case of using power from the external power device as described above, the battery is not needed, so that it would be convenient if the battery storage space can be utilized for attaching onto the attachment target. In the above prior art, however, such a point has not been taken into consideration.

SUMMARY

It is therefore an object of the present disclosure to provide a portable printer capable of easy attaching to an attachment target by the utilization of the battery storage space, an attaching adapter for use therewith, and a printer.

In order to achieve the above-described object, according to an aspect of the present application, there is provided a portable printer comprising a printer main body that includes a platen roller configured to feed a sheet to be printed, a thermal line head configured to form print on the sheet to be printed fed by the platen roller, and a housing that encompasses the platen roller and the thermal line head and includes an attachment/detachment recess configured to attach or detach a battery unit for driving the platen roller and the thermal line head, and an attaching adapter that has an outer shape substantially the same as an outer shape of the battery unit, is configured to be attached to the attachment/detachment recess of the printer main body, and includes an attachment portion for attaching the printer main body to an attachment target.

The portable printer of the present disclosure includes a configuration capable of battery drive. That is, the platen roller and the thermal line head disposed in the housing are driven by power supplied from the battery (battery unit) so that desired printing can be performed on the sheet to be printed. At this time, the battery is unitized as the battery unit as described above so that it can be attached to or detached from the attachment/detachment recess of the housing disposed on the printer main body.

On the other hand, such a portable printer of the present disclosure can be attached on a proper attachment target by using the attaching adapter separately prepared. This attaching adapter is of an outer shape substantially the same as that of the battery unit. At the time of attaching onto the attachment target, the battery unit is removed, and in place of it, the attaching adapter is attached to the attachment/detachment recess. Since the attaching adapter includes attachment portions (e.g. threaded holes) for attaching the printer main body onto the attachment target, the printer main body can easily be attached on the attachment target by using these attachment portions.

Thus, the present disclosure enables the printer main body to easily be attached on the attachment target while utilizing the battery storage space, by attaching the attaching adapter of substantially the same shape as the battery unit to the printer main body from which the battery unit is detached. This results in an improved user's convenience.

BRIEF DESCRIPTION OF THE DRAWINGS

FIG. 1 is a perspective view showing an external configuration of a printer according to an embodiment of the present disclosure.

FIG. 2 is an exploded perspective view showing a detailed structure of the printer.

FIG. 3A is a cross-sectional view taken along line Y-Y in FIG. 1, showing an internal structure of the printer.

FIG. 3B is a cross-sectional view taken along line Z-Z in FIG. 1, showing an internal structure of the printer.

FIG. 4 is a function block diagram showing a control system of the printer.

FIG. 5A is a perspective view showing a behavior performed when an attaching adapter is attached in an attachment/detachment recess.

FIG. 5B is a perspective view showing a behavior performed when a battery unit is attached in an attachment/detachment recess.

FIG. 6 is a conceptual diagram schematically showing an outer shape of the entire printer at the time of attaching of the attaching adapter or the battery unit into the attachment/detachment recess of the printer.

FIG. 7 is a bottom view of the printer when attached with the attaching adapter.

FIG. 8A is an explanatory view when the printer is attached to an attachment target, viewed from the back of the attachment target.

FIG. 8B is an explanatory view after attaching the printer to the attachment target, viewed from the back of the attachment target.

FIG. 9 is a perspective view showing the state where a guide member, a platen roller, and a heat sink are attached to a frame including a beam member, a main chassis member, and a side chassis member, with a cross-sectional view thereof taken along section a-a.

FIG. 10A is a view taken in the direction of an arrow A in FIG. 1.

FIG. 10B is a view taken in the direction of an arrow B in FIG. 1.

FIG. 10C is a perspective view showing the external appearance of the back (undersurface) of a cover member in FIG. 1.

FIG. 11 is an exploded perspective view explaining the state where the cover member is opened.

FIG. 12A is a cross-sectional view taken along line X-X in FIG. 1, showing the state where the cover member is closed.

FIG. 12B is a cross-sectional view taken along line X-X in FIG. 1, showing the state where the cover member is opened.

DETAILED DESCRIPTION OF THE PREFERRED EMBODIMENTS

An embodiment of the present disclosure will now be described with reference to the drawings.

<External Configuration>

Referring to FIGS. 1 and 2, an external configuration of a printer 1 according to an embodiment of the present disclosure will be described. In the following, description will be given with the bottom left direction in FIG. 1 indicating the front, the top right direction indicating the rear, the top left direction indicating the left, and the bottom right direction indicating the right. The top-bottom direction based on the above definitions corresponds to a first direction, with the top corresponding to one side in the first direction and the bottom corresponding to the other side in the first direction. The front-rear direction orthogonal to the top-bottom direction corresponds to a second direction, with the front corresponding to one side in the second direction and the rear corresponding to the other side in the second direction. The left-right direction orthogonal to the top-bottom direction and to the front-rear direction corresponds to a third direction.

The printer 1 prints print data received via wired communication (or wireless communication or infrared communication) from external equipment 2 (see FIG. 4 described later) such as a PC terminal or a mobile phone, on a predetermined sheet S to be printed (see FIG. 3A described later). This printer 1 can be driven by a battery unit 10 (see FIG. 4 described later) as a power source with a built-in rechargeable battery for example and is portable or carryable for use in various locations.

The printer 1 comprises a substantially rectangular-parallelepiped-shaped housing 100 forming the device contour, made of a resin material for example. The housing 100 includes a top cover 101 forming the upper contour of the printer 1, an undercover 102 forming the lower contour, and a cover member 103 disposed openably and closably on a front upper surface of the top cover 101. At the time of printing, the sheet S to be printed is inserted into an insertion port 104 extending in the left-right direction between the top cover 101 and the cover member 103 (in other words, on the upper surface of the housing 100). The inserted sheet S to be printed is guided to a facing portion P (pressure-contact portion) between a platen roller 111 and a thermal line head 112 that will be described later by a guide member 120 disposed under the insertion port 104 and, after the completion of the printing, is discharged from a discharge port 107 opening along the left-right direction between the cover member 103 and the undercover 102 (in other words, on the front side surface of the housing 100).

<Internal Configuration>

Referring to FIG. 3 and again to FIG. 2, an internal configuration of the printer 1 will be described.

The platen roller 111 and the thermal line head 112 are disposed in the housing 100 of the printer 1. The platen roller 111 extends along the left-right direction between a pair of side chassis members 130L and 130R (see FIG. 2) disposed within the interior of the housing 100, while facing the thermal line head 112 in the top-bottom direction. The platen roller 111 is covered by the cover member 103. The platen roller 111 is rotationally driven by a driving motor 11 to feed the sheet S to be printed. The thermal line head 112 is disposed on a heat sink 114 having a pivot member 113 at its rear end, the heat sink 114 being supported pivotally around the pivot member 113 by the side chassis members 130L and 130R. A main chassis member 150 is disposed on the inner surface of the undercover 102 and has a plurality of coil springs 115 (see FIG. 3) that pivotally urge the heat sink 114 supporting the thermal line head 112 toward the platen roller 111. This enables the thermal line head 112 to come into pressure contact with the platen roller 111 so that during the printing the thermal line head 112 can come into contact with the platen roller 111 at a predetermined pressure contact force to perform desired printing on the sheet S to be printed inserted therebetween. Thus, by inserting the sheet S to be printed into the insertion port 104 with the cover member 103 closed at the time of printing, the sheet S to be printed is fed by the platen roller 111 while being guided by the guide member 120 so as to be subjected to desired printing by the thermal line head 112.

The housing 100 has on its rear side an attachment/detachment recess 410 to/from which the battery unit 10 or an attaching adapter DA (details will be described later) of substantially the same shape and size as the battery unit 10 can selectively be attached/detached (FIGS. 2, 3A, and 3B show the state where the attaching adapter DA is attached). When neither the battery unit 10 nor the attaching adapter DA is attached, the attachment/detachment recess is exposed on the back side of the housing 100 (see also FIGS. 5A and 5B described later).

<Fixed Structure of Guide Member>

A fixed structure of the guide member 120 will then be described. The front-rear, left-right, and top-bottom directions referred to in the following description correspond to the respective directions in the state where components such as the guide member 120 are attached to the printer 1.

As shown in FIG. 2, the printer 1 is generally assembled by putting together a chassis assembly 50 and the top cover 101, the undercover 102, and the cover member 103 making up the housing 100. The chassis assembly 50 includes the main chassis member 150 forming the bottom of the chassis assembly 50, disposed on the inner surface of the undercover 102, and the pair of side chassis members 130L and 130R vertically extending from both ends in the longitudinal direction of the main chassis member 150. The side chassis members 130L and 130R has respective shaft holes 131 into which a shaft member 111*a* of the platen roller 111 is inserted so that the platen roller 111 is rotatably supported at its left and right ends. The side chassis members 130L and 130R pivotally support the heat sink 114 carrying the thermal line head 112 via the pivot members 113.

A gear mechanism 132 and the driving motor 11 driving the platen roller 111 are disposed on the left side chassis member 130L, the gear mechanism 132 having a plurality of gears to transmit a driving force of the driving motor 11 to the shaft member 111*a* of the platen roller 111.

A beam member 140 extends between and over the side chassis members 130L and 130R and is screwed. The guide member 120 guiding the sheet S to be printed inserted from the insertion port 104 to the facing portion P between the platen roller 111 and the thermal line head 112 is provided as a separate member apart from the top cover 101, the undercover 102, and the cover member 103 making up the housing 100. By fixing the guide member 120 to the beam member 140, the guide member 120 is disposed on the side chassis members 130L and 130R.

In the configuration described above, the housing 100 and its internal equipment and structures (in other words, parts other than the battery unit 10 and the attaching adapter DA) form a printer main body 1A (see FIGS. 5A and 5B). The printer 1 includes the printer main body 1A and the battery unit 10 (or the attaching adapter DA).

<Control System>

Referring next to FIG. 4, a control system of the printer 1 will be described.

The printer 1 has a CPU 12. The CPU 12 performs signal processing in accordance with a program previously stored in a ROM 14 while utilizing a temporary storage function of an SDRAM 13, to thereby perform the entire printer 1.

When the battery unit 10 is attached, the CPU 12 connects to the battery unit 10 and is connected to a power circuit 15 to power on/off the printer 1, a motor drive circuit 16 to perform drive control of the driving motor 11 driving the platen roller 111, and a thermal line head control circuit 17 to perform drive control of the thermal line head 112. Although not described in detail, a DC jack 25 (see FIG. 1) is disposed on the printer 1, the DC jack 25 allowing connection of a DC plug (not shown) of an external power device (with an AC adapter). The DC jack 25 is connected to the power circuit 15 so that when the DC plug is attached to the DC jack 25, the external power device can supply power to the printer 1 (in more detail, to the power circuit 15, the motor drive circuit 16, the thermal head control circuit 17, etc.).

The CPU 12 connects to a feed key 40 (see also FIG. 1) for performing a paper feed operation and a power key 30 (see also FIG. 1) for performing a power on/off operation. When the power key 30 or the feed key 40 is pressed, the CPU executes a process corresponding to the pressed key. More specifically, when the feed key 40 is pressed, the CPU 12 outputs a control signal to the motor drive circuit 16 to drive the driving motor 11 so that the platen roller 111 is rotated, to perform a feed process for feeding the sheet S to be printed by a predetermined amount. When the power key 30 is pressed with the printer 1 being powered off, the CPU 12 outputs a control signal to the power circuit 15 to perform a power on process, whereas when the power key 30 is pressed in power on state, the CPU outputs a control signal to the power circuit 15 to perform a power off process.

The CPU 12 is connected to a USB interface drive circuit 21, a wireless communication part 22, and an infrared communication part 23. The USB interface drive circuit 21 performs control of communications with the external equipment 2 via a USB cable (not shown) connected to a USB terminal 24 (see also FIG. 21). The wireless communication part 22 performs control of wireless communications by radio waves other than the infrared with the external equipment 22. The infrared communication part 23 performs control of infrared communications with the external equipment 2.

In the above configuration, when performing printing by the printer 1, the operator (user) uses the external equipment 2 such as the PC terminal or the mobile phone to input data of print to be formed on the sheet S to be printed and input a print start instruction. As a result, print data is transmitted from the external equipment 2 to the printer 1 via the USB cable (or wireless communication or infrared communication) so that printing is performed based on the print data in the printer 1.

<First Feature: Attaching Adapter>

In the printer 1 of the above basic configuration and actions, one of features of this embodiment lies in that (when power is supplied by the external equipment) the attaching adapter DA instead of the battery unit 10 is attached in the attachment/detachment recess 410 so that the printer 1 can easily be attached to any attachment target DB (e.g. vehicle-side fixed plate: dashboard, etc.; see FIG. 7 described later). The details thereof will hereinafter be described in due course.

<Attaching to/Detaching from Attachment/Detachment Recess>

In the housing 100 of the printer 1, as shown in FIGS. 5A and 5B, the attachment/detachment recess 410 is disposed from the rear edge portion of the undercover 102 toward the posterior side surface of the top cover 101. Either the battery unit 10 or the attaching adapter DA can selectively be attached in the attachment/detachment recess 410. FIG. 5A shows the case where the attaching adapter DA is attached in the attachment/detachment recess 410, while FIG. 5B shows the case where the battery unit 10 is attached in the attachment/detachment recess 410.

The undercover 102 has on its left and right a sliding hook 400 for locking the battery unit 10 (or the attaching adapter DA) attached in the attachment/detachment recess 410. At the time of attaching the battery unit 10 (or the attaching adapter DA) in the attachment/detachment recess 410, the battery unit 10 (or the attaching adapter DA) is pushed into the attachment/detachment recess 410 so that the sliding hooks 400 slide in the left-right direction away from each other against spring forces of springs arranged at bases of the sliding hooks 400. Subsequently, when the battery unit 10 (or the attaching adapter DA) is completely stored in the attachment/detachment recess 41, the sliding hooks 400 in their sliding states slide in the left-right direction coming closer to each other, resulting in the locking state. On the other hand, by allowing the sliding hooks 400 in this state to slide in the direction away from each other, the locking of the battery unit 10 (or the attaching adapter DA) in the attachment/detachment recess 410 is released, enabling removal from the attachment/detachment recess 410.

At this time, as shown in FIG. 5B, the battery unit 10 has a second connector 320A arranged on the rearward side surface at the left side. Correspondingly to this, the attachment/detachment recess 410 has a first connector 320B arranged on a rearward-facing inner wall surface 410*a*. When the battery unit 10 is attached in the attachment/detachment recess 410, the first connector 320B of the attachment/detachment recess 410 and the second connector 320A of the battery unit 10 are electrically connected, allowing power to be supplied from the battery unit 10 to the printer 1 (in more detail, to the power circuit 15, the motor drive circuit 16, the thermal head control circuit 17, etc.; see FIG. 4 described above).

On the other hand, the attaching adapter DA has substantially the same outer shape as the battery unit 10. At this time, as shown in FIG. 5A, the attaching adapter DA has a connector storage portion 310 (instead of the second connector 320A) in the shape of a substantially rectangular opening, arranged on the rearward side surface at the left side. When the attaching adapter DA is attached in the attachment/detachment recess 410, the first connector 320B of the attachment/detachment recess 410 is stored in the connector storage portion 310 of the attaching adapter DA. At the time of this attaching of the attaching adapter DA into the attachment/detachment recess 410, as shown in FIG. 7, an attaching surface (in other words, a bottom surface 102*a* of the undercover 102) of the housing 100 to the attachment target DB (see FIG. 8 described later) is substantially coplanar with an attaching surface 360 (in other words, a bottom surface) of the attaching adapter DA to the attachment target DB. Similarly, a rear side surface 102*b* of the undercover 102 of the housing 100 is substantially coplanar with a side surface 361 of the attaching adapter DA at a rear side. As a result of that, upon the attaching of the attaching adapter DA (similar to the attaching of the battery unit 10), the printer 1 presents, as a whole, an outer shape of a substantially rectangular parallelepiped F having a top surface u, a bottom surface d, a right side surface r, a left side surface 1, a front side surface f, and a rear side surface b (see FIG. 6).

As shown in FIGS. 5A and 7, the attaching adapter DA has a pair of, left and right insertion holes 330 formed on the attaching surface 360. Correspondingly to these insertion holes 330, a pair of, left and right threaded fastening portions 350 for fastening fixing bolts 340 are disposed in the downward-facing inner wall 410*b* of the attachment/detachment recess 410 (in other words, in the top inner wall of the top cover 101). Thus, the attaching adapter DA can be fixed to the attachment/detachment recess 410 by inserting the fixing bolts 340 into the insertion holes 330 of the attaching adapter DA and thereafter screwing the fixing bolts 340 into the fastening portions 350 for fastening.

As shown in FIG. 8A, the attaching adapter DA further has a pair of, left and right attachment portions (threaded holes) 500 disposed on the attaching surface (bottom surface) 360. Correspondingly to these attachment portions 500, a pair of, left and right insertion holes 510 for allowing insertion of fixing bolts 520 are formed in the attachment target DB (a desired location e.g. on a vehicle such as an automobile or a work vehicle or on a building). FIGS. 8A and 8B are views from the back of the attachment target DB. At the time of attaching the printer 1 to the attachment target DB (in this example, a vehicle-side fixed plate fixed to the dashboard for example), the attachment portions 500 of the attaching adapter DA of the printer 1 fixed to and integrated into the attachment/detachment recess 410 as described above are aligned with the insertion holes 510 of the attachment target DB. In the aligned state, the fixing bolts 520 are inserted into the insertion holes 510 from the back (from the front side in the drawing) of the attachment target DB, after which the fixing bolts 520 are screwed into the attachment portions 500 for fastening (see FIG. 8A). This enables the attaching adapter DA (in other words, the entire printer 1) to be fixed to the attachment target DB (see FIG. 8B).

<Second Feature: Light-Shielding Member>

Another feature of this embodiment lies in that light-shielding for an optical sensor 18 is provided. The details thereof will hereinafter be described in due course.

In the printer 1 of this embodiment, as described earlier with reference to FIG. 3A, the sheet S to be printed is inserted from the insertion port 104 into the interior of the housing 100 and then delivered through an introduction route RT (in other words, a route through which the sheet S to be printed is passing in FIG. 3A) formed by the guide member 120 to the facing portion P between the platen roller 111 and the thermal line head 112. The thermal line head 112 then forms print on the sheet S to be printed fed by the platen roller 111 to thereby perform desired printing on the sheet S to be printed.

The optical sensor 18 performing an optical detection of the sheet S to be printed led by the guide member 120 is disposed in the interior of the housing 100 at a position confronting the introduction route RT (in this example, at the lower wall surface of the cover member 103; may be disposed on the guide member 120). The optical sensor 18 is for example a known, so-called reflection-type sensor (may be a transmission-type sensor) and detects whether the sheet S to be printed is present or detects a mark previously formed on the sheet S to be printed. The feeding by the platen roller 111 and the print formation by the thermal line head 112 are performed under the control of the CPU 12 shown in FIG. 4 based on the result of detection of the optical sensor 18.

As shown in FIGS. 2, 3A and 3B, a substantially curtain-shaped or a substantially plate-shaped light-shielding member 19 protruding toward the introduction route RT is disposed (in more detail, on the cover member 103) in the interior of the housing 100 at a position closer to the insertion port 104 than the optical sensor 18 is close thereto. The light-shielding member 19 blocks light entered from the insertion port 104 from reaching the optical sensor 18, to thereby prevent an erroneous detection of the optical sensor 18.

In order to reduce the frictional resistance with the sheet S to be printed to perform smooth feeding, a plurality of (in this example, a multiplicity of) feeding ribs 120C (corresponding to a second rib portion) are disposed on the top surface of the guide member 120 forming the introduction route RT, as shown in FIG. 9. The feeding ribs 120C each protruding toward the introduction route RT are arranged at predetermined intervals w (see an enlarged view in FIG. 9) and come into contact with the sheet S to be printed for guiding the same.

In the case that the plurality of feeding ribs 120C are disposed as described above, the surface (the top surface in this example) of the guide member 120 toward the introduction route has unevenness due to the presence of the feeding ribs 120C (see the enlarged view in FIG. 9). Consequently, even though the light-shielding member 19 disposed protruding toward the introduction route RT as described above is brought into contact with the top surface of the guide member 120, a slight gap appears between the top surface and the end (lower end in this example) of the light-shielding member 19 due to the unevenness, if left intact. As a result, when used in strong external light environment such as the case of outdoor use, it is preferred to take some measures for fully securing the detection accuracy of the optical sensor 18, to make absolutely sure.

Thus, in this embodiment, as shown in FIGS. 2 and 9 and an enlarged view of FIG. 3A, a flat surface portion 120B is disposed on the top surface of the guide member 120 at portions other than the plurality of feeding ribs 120C. The protruding end (lower end in this example) of the light-shielding member 19 is configured to come into abutment against and substantially intimate contact with the flat surface portion 120B (in this example, while slightly loosening along the direction of the introduction route RT).

More specifically, as shown in FIGS. 3A and 10C, the optical sensor 18 is disposed on the wall surface (lower wall surface in this example) confronting the introduction route RT. The light-shielding member 19 is disposed on the lower wall surface of the cover member 103 at a position closer to the insertion port 104 than the optical sensor 18 is close thereto such that the protruding end (lower end) abuts against the flat surface portion 120B when the cover member 103 is closed. In this manner, the unevenness is eliminated at the position where the end of the light-shielding member 19 abuts so that the end can be in intimate contact therewith, thereby preventing the gap from occurring.

At this time, as shown in FIGS. 9, 10A, and 10B and the enlarged view of FIG. 3A, a recess 120A facing the optical sensor 18 is disposed on a surface (top surface in this example) of the guide member 120 toward the introduction route RT. The flat surface portion 120B is disposed closer to the insertion port 104 than the recess 120A is close thereto.

In the guide member 120, as shown in FIG. 9 and the enlarged view of FIG. 3A, the flat surface portion 120B is substantially coplanar with the protruding end surfaces (i.e. top surfaces) of the plurality of feeding ribs 120C. Some (see the range a in the enlarged view of FIG. 9) of the plurality of feeding ribs 120C are disposed continuous with the flat surface portion 120B so as to extend from the flat surface portion 120B toward the insertion port 104. At this time, as shown in an enlarged a-a section view in FIG. 9, the predetermined interval w related to the feeding ribs 120C is substantially equal to a width dimension t2 of each feeding rib 120C in the predetermined interval direction.

<Third Feature: Guide Ribs>

A further feature of this embodiment lies in that the guide member 120 has guide ribs for guiding both ends of the sheet S to be printed. The details thereof will hereinafter be described in due course.

As described above with reference to FIGS. 1, 2, 9, etc., the plurality of feeding ribs 120C (the second rib portion) are disposed on the surface (top surface in this example) of the guide member 120 toward the introduction route RT. A region (having a length L1 in the left-right direction; see FIG. 9) where these feeding ribs 120C are disposed forms a guide region GR functioning to come into contact with the underside of the sheet S to be printed in the introduction route RT to guide the sheet S to be printed.

As shown in FIG. 9 described above, guide ribs 170 (a first rib portion; not shown in FIG. 1 to avoid complexity) protruding toward the introduction route RT (top side in this example) are arranged on both end sides of the guide region GR in the left-right direction. These guide ribs 170 are disposed so as to confront the both ends of the insertion port 104 in the left-right direction.

At this time, as shown in the a-a section view in FIG. 9, the two guide ribs 170 have, on their respective inner wall surfaces (wall surfaces toward the guide region GR) facing each other, vertical surfaces 170B (corresponding to upright surfaces) vertically extending along the rib protruding direction. The guide ribs 170 have, on their respective apexes (top wall surfaces), upward convexed curved surface portions 170A whose width dimension t1 is larger than the width dimension t2 of the feeding ribs 120C.

The guide ribs 170 have a protrusion height H1 in the protruding direction larger than a protrusion height H2 in the protruding direction of the feeding ribs 120C. The guide ribs 170 are arranged in such a manner as to be downwardly inclined from the rear side toward the front side of the housing 100. As shown in FIGS. 12A and 12B, the guide ribs 170 are of a so-called substantially wedged shape when viewed from the side, in which a difference dimension ΔH between the height H1 of the guide ribs 170 and the height H2 of the feeding ribs 120C gradually decreases toward the downstream side in the feeding direction of the sheet S to be printed. As shown in FIGS. 12A and 12B, the top end surfaces of the guide ribs 170 and the feeding ribs 120C lie in substantially the same plane as the top end surfaces of the top cover 101 and the cover member 103.

The distance (equal to a length L in the left-right direction of the guide region GR) between the two guide ribs 170 is set in accordance with the paper width (hereinafter, referred to appropriately as "normal paper width") of the sheet S to be printed that the user may normally use most often. In this embodiment, the normal paper width is the A4 paper size and the distance between the guide ribs 170 is substantially equal to the normal paper width that is the width dimension of an A4 sheet S1 to be printed. When the user inserts the sheet S to be printed from the insertion port 104 as described above to start printing, if it is the A4 sheet S1 to be printed, its ends in the paper width direction are abutted against the guide ribs 170 so that the sheet S1 to be printed can easily and smoothly be positioned and set at a correct position within the introduction route RT.

Correspondingly to the two guide ribs 170, as shown in FIGS. 11 and 12 and FIG. 10 described above (see also FIGS. 1 and 2 described earlier), the cover member 103 has, on its edge portions toward the insertion port 104 at positions confronting the guide ribs 170 in the front-rear direction, recesses 103A recessed frontward with respect to the other positions. The recesses 103A each have, as shown in FIGS. 12A and 12B, an inclined surface 103Aa that is downward inclined from the front toward the rear of the housing 100. As to these two recesses 103A, the distance between the right edge of the left recess 103A and the left edge of the right recess 103A is the distance L1 (the distance in the left-right direction of the guide region GR; see FIG. 9) as shown in FIG. 1. On the other hand, the distance between the left edge of the left recess 103A and the right edge of the right recess 103A is a distance L2 (larger than the distance L1; e.g. the distance equal to the paper width of a letter size described later) shown in FIG. 1.

Thus, in the case of exceptionally using a sheet S2 to be printed of a paper width larger than the normal paper width (A4 size), e.g. of a so-called letter size (LTR), the two recesses 103A are utilized to allow the sheet S to be printed to go over the two guide ribs 170 to be set in place (see also the a-a section view in FIG. 9).

The disposition of the two recesses 103A has the following significance, in addition to the above.

That is, as already described, when printing is executed, the sheet S to be printed inserted from the insertion port 104 by the user is fed by the platen roller 111 while being guided by the guide member 120, and then is subjected to desired printing by the thermal line head 112.

At this time, in case for example the sheet S to be printed being fed as above causes a paper jam within the printer for some reason, the cover member 103 is shifted from its closed state shown in FIG. 12A to its open state shown in FIG. 12B so that the thermal line head 112 being in pressure contact with the platen roller 111 can move downward to be released therefrom (the pressure contact can be cancelled). As a result, the jammed sheet S to be printed can easily be pulled out and removed.

However, in the case of disposition of the guide ribs 170 at ends of the guide region GR as described above, if intact, the cover member 103 may interfere with the protruding guide ribs 170 when the cover member 103 is opened. The recesses 103A are disposed also in order to avoid this. When the cover member 103 is in its opened state, the guide ribs 170 come into the recesses 103A as shown in FIG. 12B (see also FIG. 11). In consequence, the above interference can be prevented. Although in FIG. 11 the cover member 103 is shown inside out for the sake of clarification of the positional relationship between the recesses 103A and the guide ribs 170 when fitted in, the cover member 103 need not be pivoted until turned inside out when opened. That is, it would be sufficient for the cover member 103 to pivot to such a degree as to allow release of the above pressure contact, i.e. to the degree shown in FIG. 12B.

Although in the above example the guide ribs 170 are disposed to left and right ends, respectively, of the guide region GR, with the two recesses 103A being disposed on the edge portions toward the insertion port 104 at positions confronting those two guide ribs 170, this is not limitative. That is, in the case that it is enough to guide only one or the other side in the left-right direction (paper width direction) of the sheet S to be printed, instead of guiding both sides in the left-right direction, the guide rib 170 may be disposed to either the left or right end of the guide region GR, with one recess 103A being disposed to a position confronting the single guide rib 170.

<Effect of The Embodiment>

As set forth hereinabove, the printer 1 of this embodiment has a configuration capable of battery drive. That is, power supplied from the battery unit 10 drives the platen roller 111 and the thermal line head 112 disposed within the housing 100, enabling desired printing to be performed on the sheet S to be printed. At this time, the battery unit 10 unitized as described above can be attached to or detached from the attachment/detachment recess 410 of the housing 100 included in the printer 1.

On the other hand, the printer 1 can be attached on a proper attachment target DB by use of the attaching adapter DA that is prepared separately. This attaching adapter DA has an outer shape substantially the same as that of the battery unit 10. At the time of attaching onto the attachment target DB, the battery unit 10 is detached from the attachment/detachment recess 410, and instead, the attaching adapter DA is attached to the attachment/detachment recess 410. At this time, the attaching adapter DA has the attachment portions 500 for attaching the printer 1 onto the attachment target, with the result that the printer 1 can easily be attached to the attachment target DB by using the attachment portions 500.

Thus, in this embodiment, the attaching adapter DA (of substantially the same shape as the battery unit 10) is attached to the printer 1 with the battery unit 10 removed, thereby enabling the printer 1 to easily be attached on the attachment target DB while utilizing the battery storage space. This leads to an improvement in the user's convenience.

In this embodiment, particularly, the attaching surface of the housing 100 to the attachment target DB lies in substantially the same plane as the attaching surface 360 of the attaching adapter DA to the attachment target DB. Consequently, in the printer 1 having the attaching adapter DA attached thereto, all the surfaces toward the attachment target DB lie in substantially the same plane, contributing to the improved stability when attached on the attachment target DB.

In this embodiment, particularly, when the attaching adapter DA is attached to the attachment/detachment recess 410, the first connector 320B of the attachment/detachment recess 410 is stored in the connector storage portion 310 of the attaching adapter DA. This enables the first connector 320B (for connection with the battery unit 10) that becomes unnecessary upon the attachment of the attaching adapter DA to be reliably protected within the connector storage portion 310 of the attaching adapter DA.

In this embodiment, particularly, the insertion holes 330 are formed in the attaching surface 360 of the attaching adapter DA, with the fastening portions 350 for fastening the fixing bolts 340 being disposed on the attachment/detachment recess 410. At the time of attaching the attaching adapter DA to the attachment/detachment recess 410, the user inserts the fixing bolts 340 into the insertion holes 330 of the attaching adapter DA and then fastens the fixing bolts 340 to the fastening portions 350 of the attachment/detachment recess 410, for fixing. By bolting after the attachment of the attaching adapter DA in this manner, the rigidity of the entire printer 1 can reliably be improved.

In the printer 1 of this embodiment, the guide member 120 has on its surface toward the introduction route RT the flat surface portion 120B disposed on the portions other than the plurality of feeding ribs 120C. The protruding end of the light-shielding member 19 is configured to abut against and come into substantially close contact with the flat surface portion 120B. By eliminating the surface unevenness at positions against which the end of the light-shielding member 19 abuts and allowing the close contact in this manner, gaps between the uneven surface arising from the feeding ribs 120C and the light-shielding member 19 can be prevented from occurring. This enables the accuracy of detection by the optical sensor 18 to be fully secured while achieving a smooth feeding by the plurality of feeding ribs 120C.

In this embodiment, particularly, the protruding end surfaces (top surfaces) of the plurality of feeding ribs 120C lie in substantially the same plane as the flat surface portion 120B. Hence, the sheet S to be printed fed on the end surfaces of the feeding ribs 120C can continue to be smoothly fed without any interference of feeding by the flat surface portion 120B.

In this embodiment, particularly, the surface (top surface) of the guide member 120 toward the introduction route RT is disposed closer to the opening 104 than the recess 120A facing the optical sensor 18 is close thereto. This allows a space defined by the recess 120A to occur on the opposite side of the sheet S to be printed when viewed from the optical sensor 18 (in other words, the sheet S to be printed is in the floating state due to the presence of the recess 120A), thereby more reliably improving the detection accuracy.

In this embodiment, particularly, some of the plurality of feeding ribs 120C are disposed continuous with the flat surface portion 120B on the side thereof closer to the insertion port 104. This allows a smooth connection (with the same protruding height) between the flat surface portion 120B and the protruding end surfaces of the feeding ribs 120C. Accordingly, the sheet S to be printed fed on the end surfaces of the feeding ribs 120C is reliably smoothly delivered intactly to the downstream flat surface portion 120B.

In this embodiment, particularly, the width dimension t2 of each of the feeding ribs 120C is substantially equal to the interval w between the adjacent ribs. This allows the multiplicity of feeding ribs 120C to be disposed on fine intervals (see FIG. 9, etc.), making it possible to reduce the amount of light incident from the diagonal direction with respect to the feeding direction of the sheet S to be printed on the guide member 120 as well as to achieve the stable feeding performance.

In the printer 1 of this embodiment, the guide member 120 has the guide region GR and the guide ribs 170, disposed on the surface toward the introduction route RT. The guide region GR comes into contact with the underside of the sheet S to be printed inserted from the insertion port 104 and advancing to the facing portion P, for guiding. Correspondingly to this guide region GR, the guide ribs 170 are disposed in such a manner as to confront the insertion port 104. Hence, at the time of inserting the sheet S to be printed from the insertion port 104 to cause the leading edge thereof to arrive at the facing portion P as described above to start printing, the user brings the ends in the paper width direction of the sheet S to be printed into abutment against the guide ribs 170 so that the sheet S to be printed can easily and smoothly be positioned and set in place in the introduction route RT.

At this time, the recesses 103A are disposed on the edge of the cover member 103 toward the insertion port 104 at positions confronting the guide ribs 170. This enables the protruding guide ribs 170 to come into the recesses 103A at the time of the opening action of the cover member 103 to clear the paper jamming, to prevent any interference between the guide ribs 170 and the cover member 103 to secure a smooth opening/closing action.

It is thus possible in this embodiment to reliably easily set the sheet S to be printed in place and to secure a smooth opening/closing action of the cover member 103 (i.e., to achieve both good paper setting property and opening/closing smoothness at one time).

In this embodiment, particularly, the two guide ribs 170 are disposed on the both ends of the guide region GR. The distance between the two guide ribs 170 is substantially equal to the width dimension of the sheet S to be printed of A4 paper size. Hence, the user causes the both ends in the paper width direction to abut against the two guide ribs 170, respectively, thereby enabling the sheet S to be printed of A4 paper size that is most often used to be easily and smoothly positioned and set in place (by so-called centering). In the case of using the sheet S2 to be printed of a paper width (letter size in the above example) larger than the A4 paper size, the two recesses 103A are utilized to allow the sheet S to be printed to go over the two guide ribs 170 to be easily set in place. It is thus possible in this embodiment not only to reliably guide the sheet S1 to be printed of A4 paper size but also to easily set the sheet S2 to be printed of a paper width larger than that.

In this embodiment, particularly, the guide ribs 170 have, on their respective wall surfaces toward the guide region GR, the vertical surfaces 170B vertically extending in the protruding direction. This allows the vertical surfaces 170B to come into contact with the sheet S to be printed (in more detail, the sheet S1 to be printed of A4 paper size) for guiding, thereby ensuring the straightness during the feeding of paper to prevent skewing.

In this embodiment, particularly, the guide ribs 170 have, on their respective top wall surfaces, curved surface portions 170A. By virtue of this, when using a sheet S to be printed (the sheet S2 to be printed of letter size in the above example) of a paper width larger than the normal paper width, the sheet S to be printed can smoothly go over the guide ribs 170 and can reliably easily be positioned in place.

In this embodiment, particularly, the guide ribs 170 come into the recesses 103A when the cover member 103 is in its open state. This reliably prevents the guide ribs 170 from interfering with the cover member 103 when the cover member 103 is opened.

In this embodiment, particularly, the guide region GR has feeding ribs 120C whose protruding height is smaller than that of the guide ribs 170. This reduces the frictional resistance between the guide region GR and the sheet S to be printed, contributing to an improvement in the feeding smoothness.

In this embodiment, particularly, the top end surfaces of the guide ribs 170 and the feeding ribs 120C lie in substantially the same plane as the top end surfaces of the top cover 101 and the cover member 103. This can prevent the guide ribs 170 and the feeding ribs 120C from protruding from the contour of the printer 1, making it possible to improve the aesthetic appearance as well as to improve the stability when the printer 1 is placed.

In this embodiment, particularly, the guide ribs 170 have a substantially wedged shape in which the difference dimension ΔH in height from the feeding ribs 120C decreases toward the downstream side in the feeding direction of the sheet S to be printed. Hence, the guide ribs 170 can exhibit a guiding effect that increases toward the upstream side in the feeding direction where the sheet S to be printed is inserted, while simultaneously reducing the difference in height between the guide ribs 170 and the feeding ribs 120C toward the downstream side in the feeding direction, to improve the going-over property.

In this embodiment, particularly, the guide ribs 170 incline downward from the rear toward the front, whereas the recesses 103A have inclined surfaces 103Aa that incline downward from the front toward the rear. Due to such a configuration in which the direction of inclination of the inclined surfaces 103Aa of the recesses 103A is opposite to the direction of inclination of the guide ribs 170, it is possible as shown in FIG. 12B to secure the degree of opening of the openable cover member 103 to the maximum while avoiding the interference.

In the above, arrows shown in the diagram of FIG. 4 indicate an example of flow of signals and are not intended to limit the direction of flow of signals.

Other than those already described, techniques of the above embodiment and various modification examples may appropriately be combined for use.

What is claimed is:

1. A portable printer comprising:

a printer main body that includes a platen roller configured to feed a sheet to be printed, a thermal line head configured to form printing on said sheet to be printed fed by said platen roller, and a housing that encompasses said platen roller and said thermal line head and includes an attachment/detachment recess configured to attach or detach a battery unit for driving said platen roller and said thermal line head; and an attaching adapter separate and distinct from the battery unit and that has an outer shape substantially the same as an outer shape of said battery unit, the attaching adapter configured to be attached to said attachment/detachment recess of said printer main body interchangeably with the battery unit such that the attaching adapter and the battery unit are not attached to the printer main body at the same time, and includes an attachment portion for attaching said printer main body to an attachment target separate from the portable printer.

2. The portable printer according to claim 1, wherein when attaching said attaching adapter to said attachment/detachment recess, an attaching surface of said printer main body facing said attachment target is coplanar with an attaching surface of said attaching adapter facing said attachment target.

3. The portable printer according to claim 2, wherein when attaching said attaching adapter to said attachment/detachment recess, said printer has an outer shape of a substantially rectangular parallelepiped as a whole.

4. The portable printer according to claim 1, wherein:

said attachment/detachment recess includes a first connector configured to be connected to a second connector disposed on said battery unit, and said attaching adapter includes a connector storage portion configured to store said first connector when attached to said attachment/detachment recess.

5. The portable printer according to claim 1, wherein:

said attaching adapter includes an insertion hole configured to allow insertion of a fixing bolt for fixation to said printer main body, and said attachment/detachment recess includes a fastening portion configured to fasten said fixing bolt inserted into said insertion hole of said attaching adapter attached thereto.

6. An attaching adapter configured to be attached to an attachment/detachment recess disposed on a printer main body of a portable printer, said attachment/detachment recess being configured to allow attachment/detachment of a battery unit interchangeably with the attaching adapter, the attaching adapter comprising:

an outer shape substantially the same as an outer shape of said battery unit, and an attachment portion for attaching said printer main body to an attachment target, wherein the attachment portion is separate and distinct from the battery unit.

7. The attaching adapter according to claim 6, further comprising a connector storage portion.

8. The attaching adapter according to claim 6, further comprising an insertion hole.

* * * * *